US009046848B2

(12) United States Patent
Tomishima

(10) Patent No.: US 9,046,848 B2
(45) Date of Patent: Jun. 2, 2015

(54) IMAGE FORMING APPARATUS AND COLOR REGISTRATION METHOD OF THE SAME

(71) Applicant: SAMSUNG ELECTRONICS CO., LTD., Suwon-si, Gyeonggi-do (KR)

(72) Inventor: Yuichiro Tomishima, Yokohama (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 145 days.

(21) Appl. No.: 13/706,957

(22) Filed: Dec. 6, 2012

(65) Prior Publication Data

US 2013/0149014 A1 Jun. 13, 2013

(30) Foreign Application Priority Data

Dec. 9, 2011 (JP) ..... 2011-270517
Nov. 29, 2012 (KR) ..... 10-2012-0137341

(51) Int. Cl.
*G03G 15/01* (2006.01)
*G03G 15/00* (2006.01)

(52) U.S. Cl.
CPC ..... *G03G 15/5054* (2013.01); *G03G 15/0189* (2013.01); *G03G 15/5058* (2013.01); *G03G 2215/0132* (2013.01); *G03G 2215/0161* (2013.01)

(58) Field of Classification Search
CPC ..... G03G 15/0131; G03G 2215/0161
USPC ..... 399/301
See application file for complete search history.

(56) References Cited

U.S. PATENT DOCUMENTS

2003/0052958 A1 3/2003 Shinohara
2006/0263120 A1* 11/2006 Hayakawa ..... 399/301
2008/0013972 A1 1/2008 Matsuda

FOREIGN PATENT DOCUMENTS

EP 1 781 012 5/2007
EP 2 549 334 1/2013
JP 2002-55502 2/2002

OTHER PUBLICATIONS

European Search Report issued Jun. 24, 2013 in corresponding European Application No. 12 19 5755.

* cited by examiner

*Primary Examiner* — David Bolduc
*Assistant Examiner* — Barnabas Fekete
(74) *Attorney, Agent, or Firm* — Staas & Halsey LLP

(57) ABSTRACT

An image forming apparatus which obtains rotational variance factors of an intermediate transfer belt for each of plurality of colors based on locations with respect to second pattern image being obtained by a location calculation unit, corrects the location obtained with respect to a first pattern image based on the rotational variance factor obtained with respect to the color of the first pattern image, obtains an offset of another color with respect to a reference color based on the location after correction, and performs color registration based on the obtained offset to reduce the offset.

10 Claims, 13 Drawing Sheets

FIG. 9

| HSY COUNT VALUE | EY(dot) |
|---|---|
| 0 | 0.22 |
| 100 | 0.24 |
| 200 | 0.26 |
| 300 | 0.32 |
| 400 | 0.34 |
| 500 | 0.38 |
| 600 | 0.43 |
| 700 | 0.46 |
| 800 | 0.48 |
| 900 | 0.52 |
| 1000 | 0.58 |
| 1100 | 0.58 |
| 1200 | 0.54 |
| 1300 | 0.54 |
| 1400 | 0.46 |
| 1500 | 0.44 |
| 1600 | 0.44 |
| 1700 | 0.42 |
| ⋮ | ⋮ |

IMAGE FORMING APPARATUS AND COLOR REGISTRATION METHOD OF THE SAME

CROSS-REFERENCE TO RELATED APPLICATIONS

This application claims the benefit of Japanese Patent Application No. 2011-270517, filed on Dec. 9, 2011, in the Japanese Patent Office, and Korean Patent Application No. 10-2012-0137341, filed on Nov. 29, 2012, in the Korean Intellectual Property Office, the disclosures of which are incorporated herein in its entirety by reference.

BACKGROUND

1. Field

The present disclosure relates to an image forming apparatus forming a color image.

2. Description of the Related Art

There are known image forming apparatuses transferring toner images of respective colors to an intermediate transfer belt and additionally transferring toner images to recording media such as paper. There occurs misalignment in location between toner images of respective colors due to a deformation or an eccentric of rollers driving a transfer belt and misalignment in location between photosensitive drums of respective colors transferring toner images to the transfer belt. To print exact colors, it is needed to perform color registration for correcting such a color out of register. There is disclosed an example thereof in Japanese Patent Publication No. 2002-55502.

However, a printer as disclosed in Japanese Patent Publication No. 2002-55502 just adjusts a timing when delays of photosensitive belts for respective colors being driven by rollers arrive at a maximum value, and cannot correct either a size of the misalignment in location of toner images or a variance period thereof, for the respective colors.

SUMMARY

The present disclosure provides performing color registration with a higher degree of precision.

Additional aspects and/or advantages will be set forth in part in the description which follows and, in part, will be apparent from the description, or may be learned by practice of the disclosure.

According to an aspect of the present disclosure, there is provided an image forming apparatus forming an image in a plurality of colors including a reference color. The apparatus includes: an image forming part forming a first pattern image and a second pattern image in the same color side by side in a main scanning direction, with respect to each of the plurality of colors; an intermediate transfer belt to which the first pattern image and the second pattern image formed by the image forming part are transferred, the intermediate transfer belt conveying the transferred first pattern image and second pattern image in a sub-scanning direction; a first sensing unit to sense an element of the first pattern image on the intermediate transfer belt; a second sensing unit to sense an element of the second pattern image on the intermediate transfer belt; a location calculation unit to obtain locations in the sub-scanning direction for the elements of the first pattern images and second pattern images of the plurality of colors on the intermediate transfer belt based on results of sensing performed by the first and second sensing units; and a control unit to obtain rotational variance factors of the intermediate transfer belt for each of the plurality of colors based on the locations with respect to the second pattern image being obtained by the location calculation unit, correct the location obtained with respect to the first pattern image based on the rotational variance factor obtained with respect to the color of the first pattern image, obtain an offset of another color with respect to the reference color based on the location after correction, and perform color registration based on the obtained offset to reduce the offset, wherein the first pattern image is an image to obtain an offset of another color with respect to the reference color among the plurality of colors, and wherein the second pattern image is an image to obtain a movement of the intermediate transfer belt in the sub-scanning direction.

According thereto, there is obtained an offset with respect to the reference color by considering a rotational variance factor by using pattern images of the same color being arranged side by side in the main scanning direction. Since the rotational variance factor is considered, it is possible to perform color registration with a higher degree of precision.

According to another aspect of the present disclosure, there is provided a color registration method performed by an image forming apparatus forming an image in a plurality of colors including a reference color. The method includes: forming a first pattern image and a second pattern image in the same color with respect to each of the plurality of colors being arranged side by side in a main scanning direction; transferring the first pattern image and the second pattern image formed by the image forming part to an intermediate transfer belt and conveying the transferred first pattern image and second pattern image in a sub-scanning direction; sensing an element of the first pattern image on the intermediate transfer belt; sensing an element of the second pattern image on the intermediate transfer belt; obtaining locations in the sub-scanning direction for the elements of the first pattern images and second pattern images of the plurality of colors on the intermediate transfer belt based on results of sensing performed by the first and second sensing units; and obtaining rotational variance factors of the intermediate transfer belt for each of the plurality of colors based on the locations with respect to the second pattern image being obtained by the location calculation unit, correcting the location obtained with respect to the first pattern image based on the rotational variance factor obtained with respect to the color of the first pattern image, obtaining an offset of another color with respect to the reference color based on the location after correction, and performing color registration based on the obtained offset to reduce the offset, wherein the first pattern image is an image for obtaining an offset of another color with respect to the reference color among the plurality of colors, and wherein the second pattern image is an image for obtaining a movement of the intermediate transfer belt in the sub-scanning direction.

BRIEF DESCRIPTION OF THE DRAWINGS

The above and other features and advantages of the present disclosure will become more apparent by describing in detail exemplary embodiments thereof with reference to the attached drawings in which:

FIG. 9 is a table illustrating an example of a rotational variance factor;

DETAILED DESCRIPTION

The present disclosure will now be described more fully with reference to the accompanying drawings, in which exemplary embodiments of the present disclosure are shown.

Figure 1:
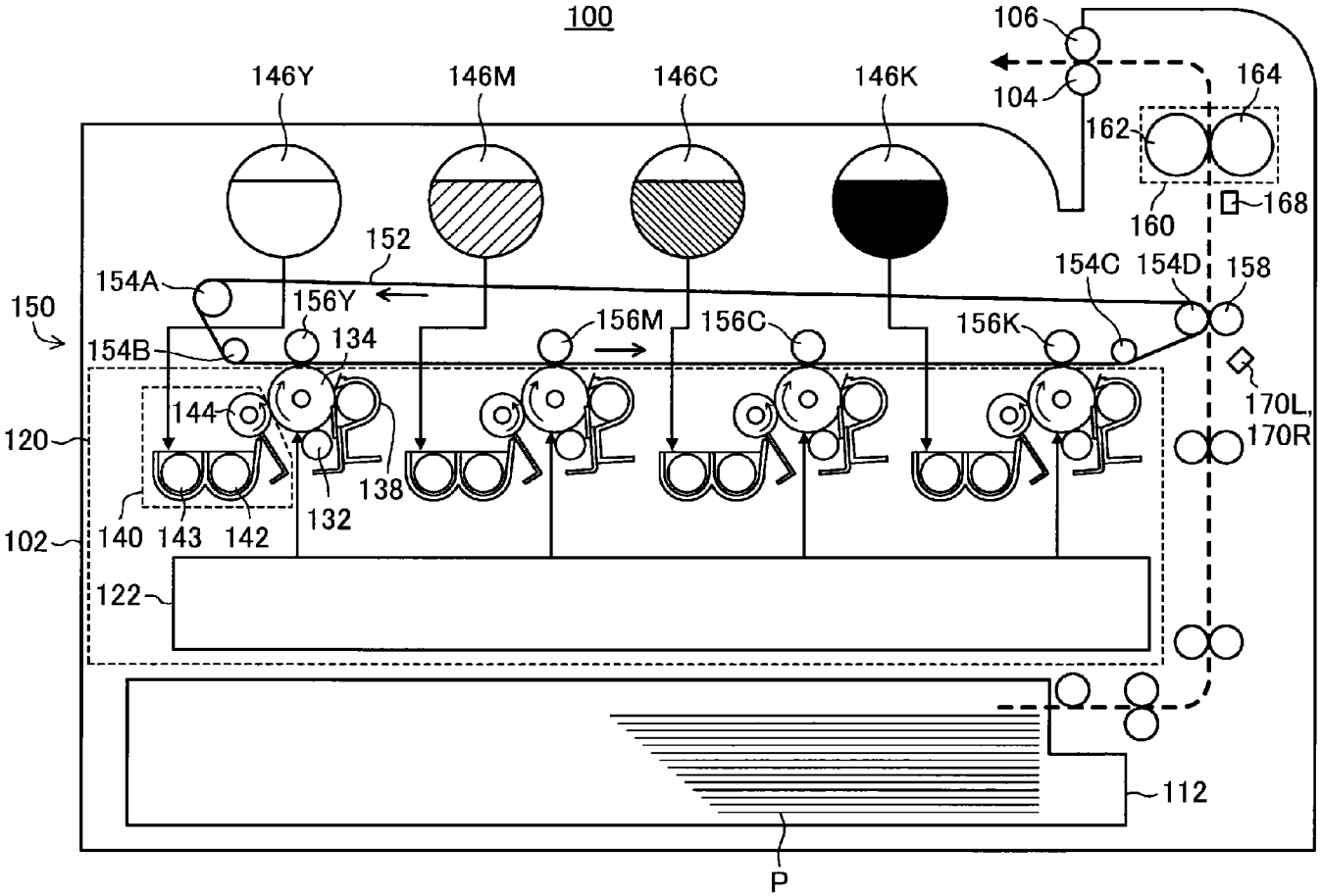
FIG. 1 is a schematic view illustrating an example of an image forming apparatus according to an embodiment of the present disclosure.

FIG. 1 is a schematic view illustrating an example of an image forming apparatus 100 according to an embodiment of the present disclosure. The image forming apparatus 100 forms a color image by forming a plurality of images for respective colors including reference color and may include a recording medium feed unit 112, an image forming part 120, toner tanks 146Y, 146M, 146C, and 146K, a transfer unit 150, a fixing unit 160, and sensing units 170L and 170R.

The recording medium feed unit 112 contains recording media where images are to be formed finally, and feeds the recording media onto a recording medium feeding path. The recording media are, for example, paper P and contained in a cassette while being stacked. The recording medium feed unit 112 feeds the paper P to a second transfer area at a time when a toner image to be transferred to the paper P is formed and conveyed to the second transfer area.

The transfer unit 150 conveys a toner image formed by a developing unit 140 to the second transfer area for secondly transferring the toner image to the recording medium. The transfer unit 150 may include an intermediate transfer belt 152, suspension rollers 154A, 154B, 154C, and 154D suspending the intermediate transfer belt 152, first transfer rollers 156Y, 156M, 156C, and 156K, and a second transfer roller 158.

Figure 2:
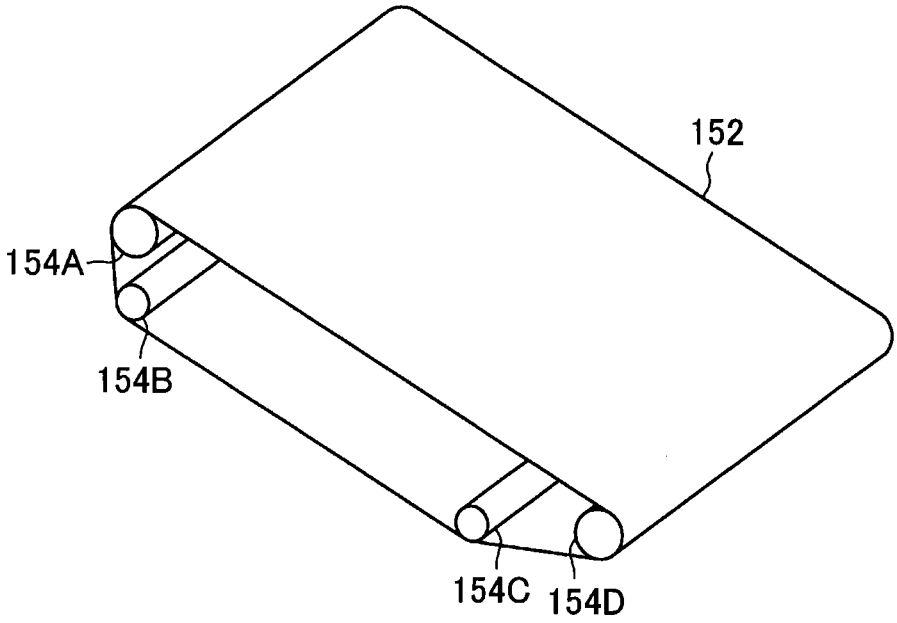
FIG. 2 is a diagram illustrating a transfer belt of FIG. 1.

FIG. 2 is a diagram illustrating the intermediate transfer belt 152 of FIG. 1. The intermediate transfer belt 152 may be an endless belt circulated by the suspension rollers 154A, 1546, 154C, and 154D. On a surface of the intermediate transfer belt 152, a toner image is formed by the image forming part 120. Hereinafter, the intermediate transfer belt is referred to as just "the transfer belt".

As shown in FIG. 1, the first transfer rollers 156Y, 156M, 156C, and 156K and corresponding photosensitive drums 134 interpose the transfer belt 152 therebetween. The second transfer roller 158 and the suspension roller 154D interpose the transfer belt 152 therebetween. The first transfer rollers 156Y, 156M, 156C, and 156K are installed to pressurize the photosensitive drums 134 from an inner circumferential side of the transfer belt 152. The second transfer roller 158 is installed to pressurize the suspension roller 154D from an outer circumferential side of the transfer belt 152. Also, not shown in FIG. 1, the transfer unit 150 may further include a belt cleaning device removing toner attached to the transfer belt 152.

The image forming part 120 may include a charging roller 132, the photosensitive drum 134, a cleaning unit 138, and the developing unit 140 for each of four colors, for example, yellow Y, magenta M, cyan C, and black K. Four photosensitive drums 134 are installed along a conveying direction of the transfer belt 152. The image forming part 120 additionally includes an exposing unit 122. In this case, as an example, there will be a description with respect to yellow. However, magenta, cyan, and black images are formed as the same manner.

As shown in FIG. 1, the charging roller 132, the cleaning unit 138, and the developing unit 140 are arranged along a circumference of each of the photosensitive drum 134. The photosensitive drum 134 is an electrostatic latent image bearing medium, on a circumferential surface thereof an image being formed. For example, an organic photo conductor (OPC) is used. The charging roller 132 uniformly charges a surface of the photosensitive drum 134 by a predetermined potential. The exposing unit 122 is, for example, a laser scanning unit (LSU) and scans light according to an image to be formed to the surface of the photosensitive drum 134 charged by the charging roller 132. Accordingly, potential of an area of the surface of the photosensitive drum 134 being light-exposed by the exposing unit 122 is changed, thereby forming an electrostatic latent image. The developing unit 140 develops the electrostatic latent image formed on the photosensitive drum 134 using toner supplied from the toner tank 146Y and generates a toner image.

The cleaning unit 138 collects residual toner on the photosensitive drum 134 after the toner image formed on the photosensitive drum 134 is firstly transferred to the transfer belt 152. The cleaning unit 138 is configured by, for example, installing a cleaning blade and allowing the cleaning blade to be in contact with a circumferential surface of the photosensitive drum 134, thereby removing the residual toner on the photosensitive drum 134. Also, it is possible to dispose an eraser lamp (not shown) erasing electric potential of the photosensitive drum 134 between the cleaning unit 138 and the charging roller 132 along the circumferential surface of the photosensitive drum 134.

The developing unit 140 may include agitating-conveying parts 142 and 143 and a developing roller 144. The developing roller 144 is a developer-bearing member supplying toner with respect to the electrostatic latent image formed on the circumferential surface of the photosensitive drum 134. The agitating-conveying parts 142 and 143 agitate a magnetic carrier, and nonmagnetic toner forming the developer and charges the carrier and the toner. A first agitating-conveying part 142 is arranged opposite to the developing roller 144 in an approximately vertical direction and supplies the mixed, agitated developer to the developing roller 144. A second agitating-conveying part 143 mixes and agitates the developer to be fully charged and conveys the charged developer to the agitating-conveying part 142. In the second agitating-conveying part 143, a toner concentration sensor (not shown) for sensing toner concentration may be provided, and the developer is supplied to the feeding path from the toner tank 146Y when the toner concentration in the feeding path decreases.

The fixing unit 160 attaches and fixes the toner image to a recording medium, the toner image being secondarily transferred to the recording medium from the transfer belt 152. The fixing unit 160 includes, for example, a heating roller 162 and a compressing roller 164. The heating roller 162 may be a cylindrical member functioning as a fixing roller rotatable around a rotation axis, inside of which, for example, a heat source such as a halogen lamp may be installed. The compressing roller 164 may be a cylindrical member rotatable around a rotation axis and is installed to compress the heating roller 162. On outer circumferential surfaces of the heating roller 162 and the compressing roller 164, elastic heat-resistant layers, for example, silicone or rubber, are installed. The recording medium passes through a fixing nip portion that is a contact area between the heating roller 162 and the compressing roller 164, thereby melting and fixing the toner image on the recording medium.

Between a second transfer area where the secondary transfer from the transfer belt 152 to the recording medium occurs and the fixing unit 160, there may be installed a feed sensor 168 sensing a feeding state of the recording medium. The feeding sensor 168 senses whether the recording medium passes through a location where the feeding sensor 168 is installed. Also, the image forming apparatus 100 may include discharging rollers 104 and 106 for discharging the recording medium where the toner image is fixed by the fixing unit 160 outside the housing 102 of the image forming apparatus.

Firstly, when the image forming apparatus is operated, image data of an image to be printed are transmitted to a signal generator. Then, a controller controls the charging roller 132 to uniformly charge the surface of the photosensitive drum 134 at a predetermined electric potential and then controls the exposing unit 122 to scan laser beams to the surface of the photosensitive drum 134 based on the image data received by the signal generator, thereby forming an electrostatic latent image.

In the developing unit 140, toner and a carrier are mixed and agitated to be fully charged and then a developer is borne in the developing roller 144. Also, when the developer is conveyed to an area facing the photosensitive drum 134 by a rotation of the developing roller 144, toner of the developer borne in the developing roller 144 is supplied to the electrostatic latent image formed on the circumferential surface of the photosensitive drum 134 and the electrostatic latent image is developed. A toner image formed as described above is firstly transferred from the photosensitive drum 134 to the transfer belt 152 in the area where the photosensitive drum 134 faces the transfer belt 152. On the transfer belt 152, toner images formed on the four photosensitive drums 134 are sequentially stacked and form a stacked toner image. Also, the stacked toner image is secondarily transferred to a recording medium conveyed from the recording medium feed unit 112 in an area between the suspension roller 154D and the second transfer roller 158.

The recording medium where the stacked toner image is secondarily transferred is conveyed to the fixing unit 160. The recording medium passes through between the heating roller 162 and the compressing roller 164 while receiving heat and pressure therefrom, thereby melting and fixing the stacked toner image on the recording medium. After that, the recording medium is discharged outside the image forming apparatus 100 by the discharging rollers 104 and 106. After the stacked toner image is secondarily transferred to the recording medium, residual toner on the transfer belt 152 is removed by the belt cleaning device.

Figure 3:
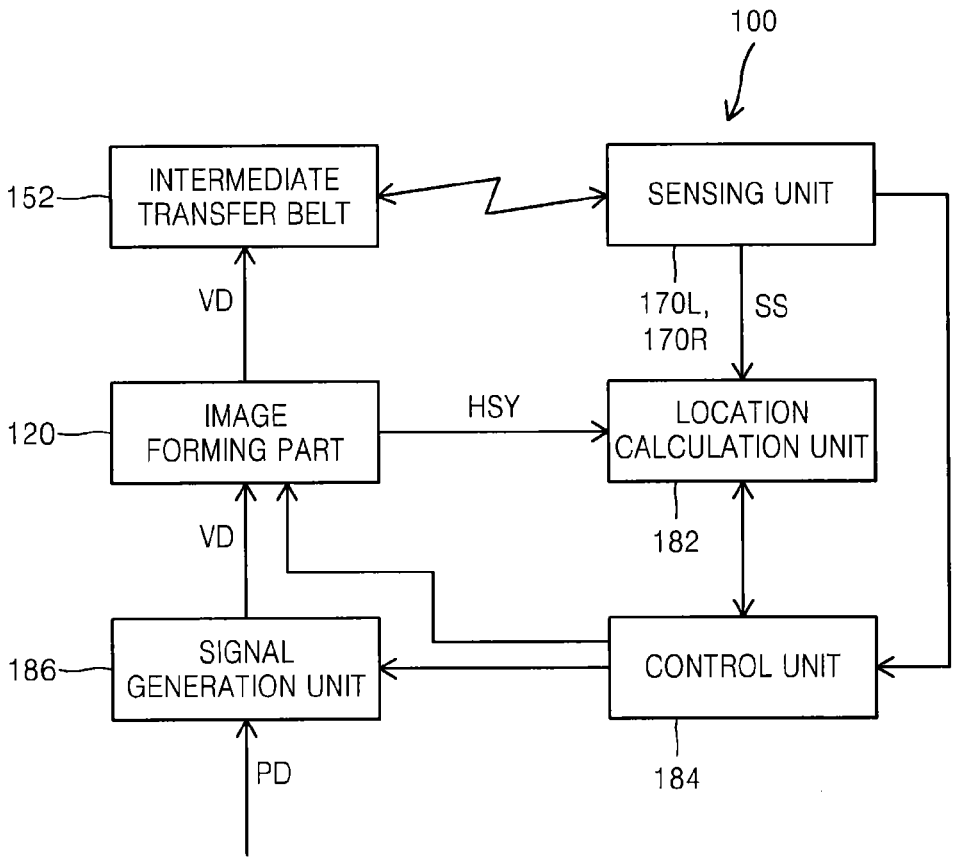
FIG. 3 is a block diagram illustrating an example of a configuration of a part related to color registration of the image forming apparatus of FIG. 1.

FIG. 3 is a block diagram illustrating an example of a configuration of a part related to the color registration of the image forming apparatus 100. As shown in FIG. 3, the image forming apparatus 100 may include a location calculation unit 182, a control unit 184, and a signal generation unit 186 in addition to the image forming part 120, the transfer belt 152, and the sensing units 170L and 170R shown in FIG. 1. The control unit 184, for example, as a central processing unit (CPU), controls the entire image forming apparatus 100, which will be described with reference to FIG. 3 and other drawings.

Figure 4:
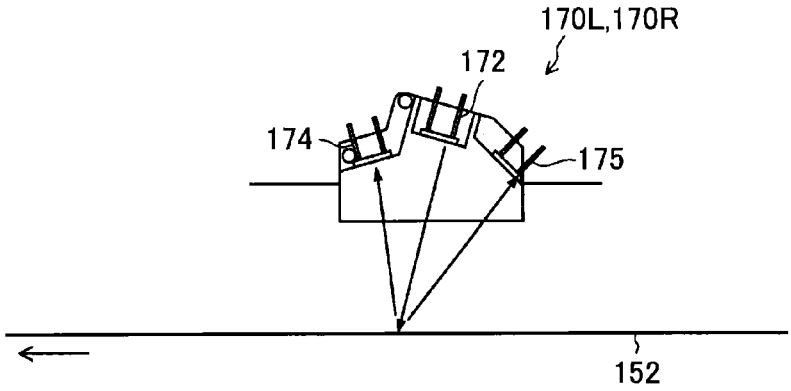
FIG. 4 is a diagram illustrating an example of a configuration of a sensing unit of FIG. 3.

FIG. 4 is a diagram illustrating an example of a configuration of the sensing unit 170L of FIG. 3. As shown in FIG. 4, the sensing unit 170L may include a light emitting diode (LED) 172 and photo sensors 174 and 175. It may be possible to use other devices such as laser diodes instead of the LED 172. The sensing unit 170R has the same configuration as the sensing unit 170L. The LED 172 scans light to a portion on the transfer belt 152, and the transfer belt 152 and a toner image formed thereon reflect or scatter the scanned light. The photo sensors 174 and 175 receive the reflected or scattered light from the transfer belt 152 and the toner image formed thereon, and output signals according to the strength of the received light. The sensing unit 170L outputs a sensing signal SS, for example, a sum of output signals of the photo sensors 174 and 175 to the location calculation unit 182.

Figure 5:
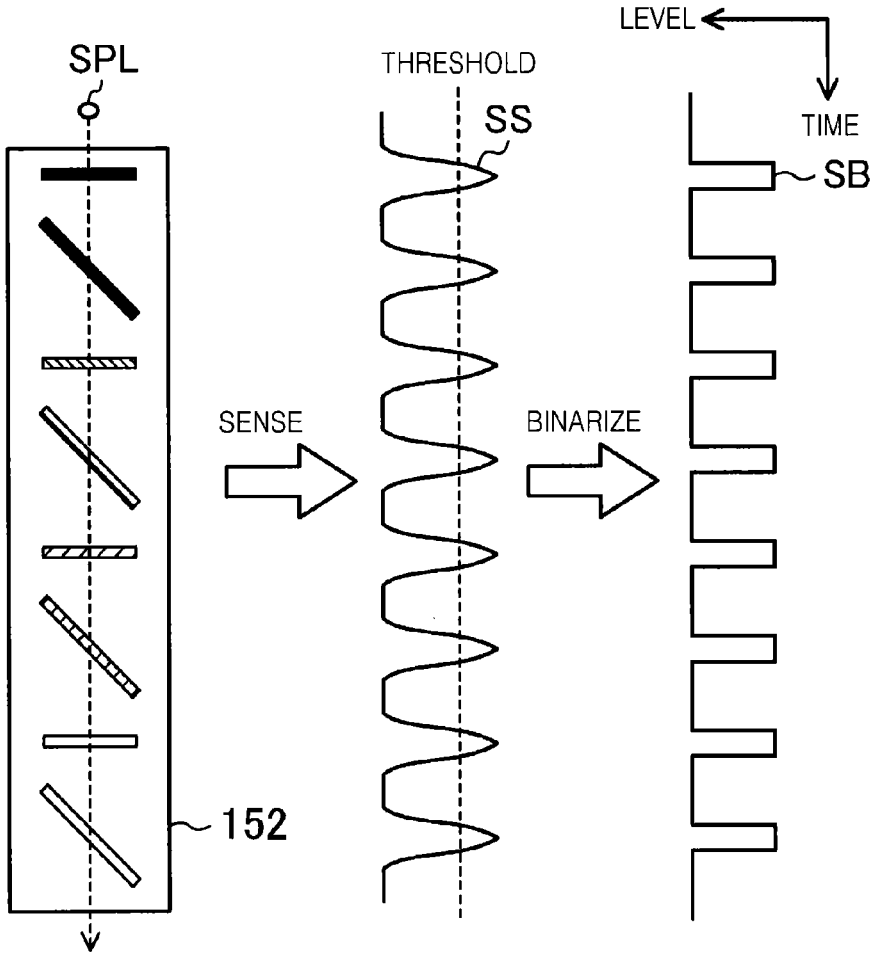
FIG. 5 is a diagram illustrating a process of measuring a location of a toner image on an intermediate transfer belt of FIG. 1.

FIG. 5 is a diagram illustrating a process of measuring a location of a toner image on the intermediate transfer belt 152 of FIG. 1. A spot SPL formed by light scanned from the LED 172 moves relatively to a bottom side of FIG. 5, as the transfer belt 152 rotates. In FIG. 5, there is shown an example of the sensing signal SS outputted from the sensing unit 170L in this case. The location calculation unit 182 binarizes the sensing signal SS. That is, the location calculation unit 182 generates a signal SB becoming high potential when the sensing signal SS is a threshold or more and becoming low potential when the sensing signal SS is less than the threshold.

The location calculation unit 182 may include a counter counting the number of pulses of a synchronization signal HSY outputted from the image forming part 120 and outputs a count value of the counter at a time corresponding to, for example, descending edge of each pulse to the control unit 184. The control unit 184 stores the count value. The synchronization signal HSY is a clock signal with high frequency, which is the reference signal of controlling the entire image forming apparatus 100. Since the frequency of the synchronization signal HSY is very higher than that of the signal SB, it is possible to show the location of the toner image on the transfer belt 152 according to the count value.

The control unit 184 generates and outputs a page synchronization signal, a line synchronization signal, and a video clock signal to the signal generation unit 186. Also, the control unit 184 generates and outputs a motor clock controlling a motor for scanning of the exposing unit 122 to the exposing unit 122. The signal generation unit 186 generates a video signal VD according to image data PD inputted from the outside of the image forming apparatus 100 and synchronizes and outputs the video signal VD with the page synchronization signal, the line synchronization signal, and the video clock signal to the image forming part 120. The image forming part 120 forms an image based on the video signal VD. The signal generation unit 186 may store data of a pattern image for color registration.

Figure 6:
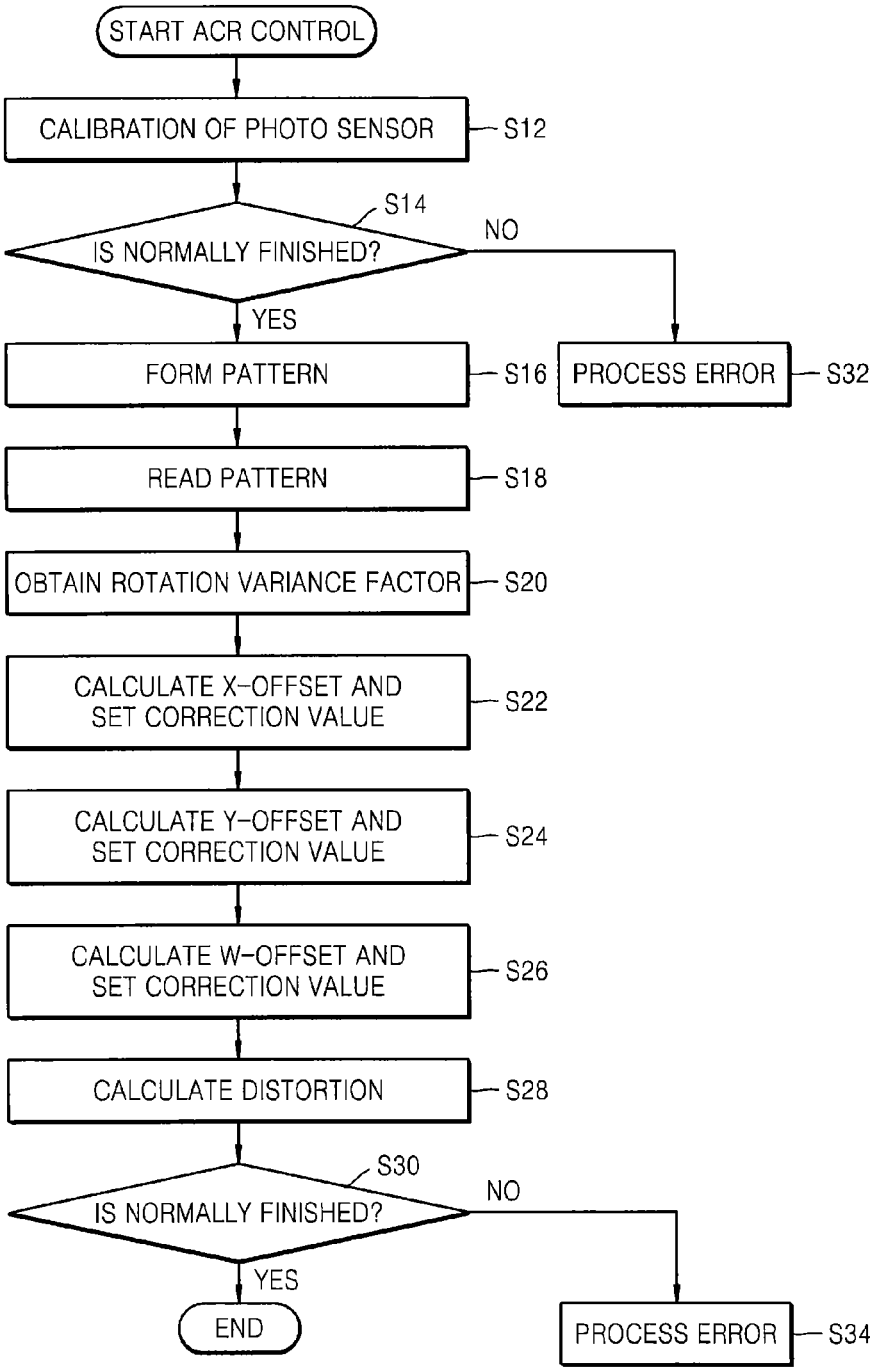
FIG. 6 is a flowchart illustrating an example of a process of measuring and processing an offset in the image forming apparatus of FIG. 1.

FIG. 6 is a flowchart illustrating an example of a process of measuring and processing an offset in the image forming apparatus 100. In S12, the control unit 184 calibrates the LEDs 172 of the sensing units 170L and 170R. In detail, the control unit 184 sets a current of the LED 172 to allow the location sensing unit 182 to determine whether a toner image is present on the surface of the transfer belt 152 or not from the sensing signal SS. When it is impossible to determine whether the toner image is present or not, the control unit 184 sets the current of the LED 172 to be a different value. When it is still impossible to determine whether the toner image is present after changing the current of the LED 172 several times, the control unit 184 sets a flag showing that the calibration is impossible.

In S14, the control unit 184 determines whether the calibration is normally finished. When normally finishing the calibration, S16 is performed. When not normally finishing the calibration, S32 is performed. In S32, the control unit 184 processes an error. In detail, the control unit 184 stops a color registration process, notifies a user of error information indicating that the calibration process is not normally finished, and finishes the process. In this case, the control unit 184 may display the error information on a display (not shown) or may notify the error information to an administration center via a communication line. When the calibration process is not normally finished, a color registration process may be performed using a setting of a previous calibration process, that is, S16 may be performed.

In S16, according to a command of the control unit 184, the signal generation unit 186 reads stored data of a pattern image for color registration and generates and outputs an image signal VD corresponding thereto to the image forming part 120. The image forming part 120 forms a pattern image for color registration according to the image signal VD and transfers the pattern image to the transfer belt 152.

Figure 7:
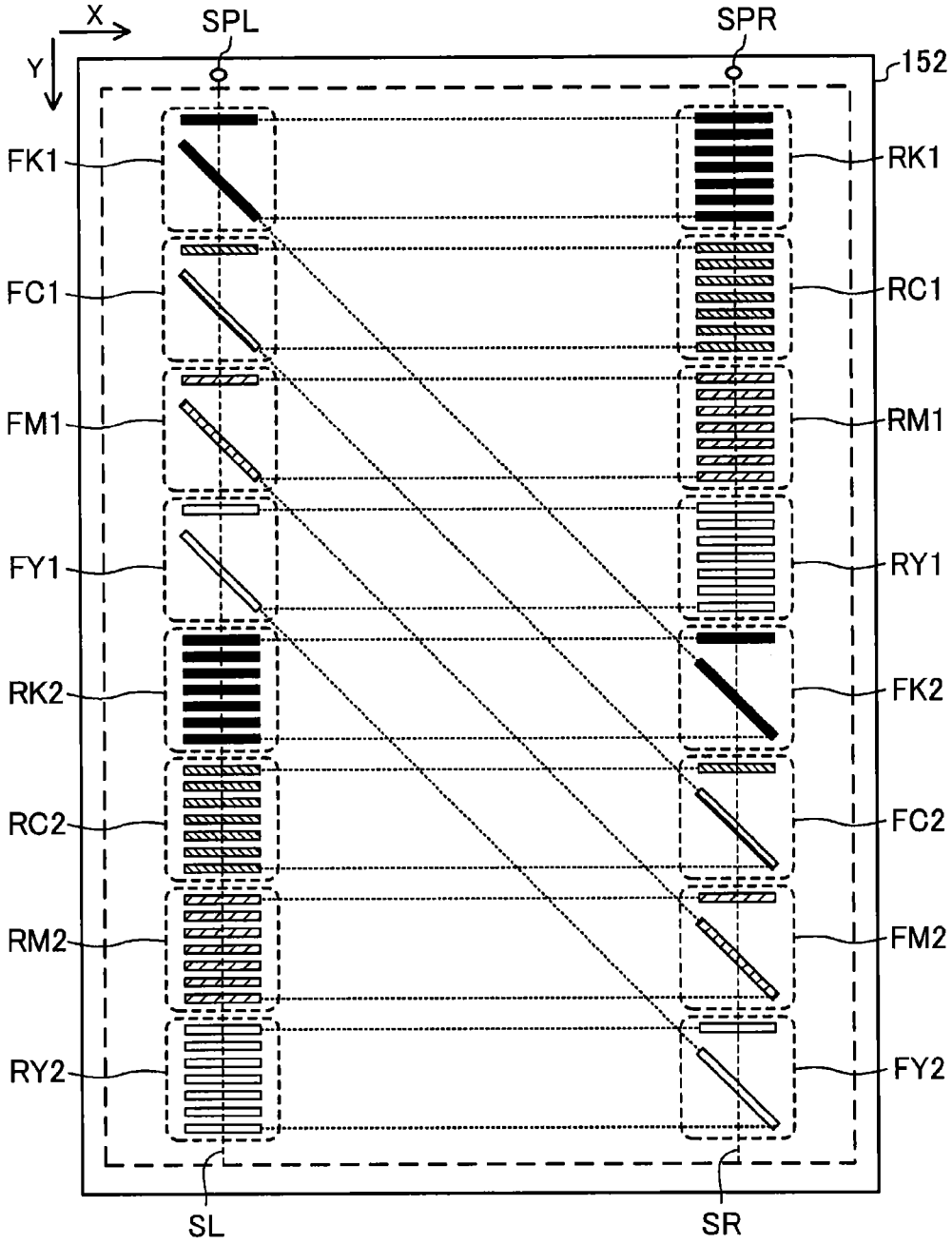
FIG. 7 is a diagram illustrating an example of a pattern image for color registration.

FIG. 7 is a diagram illustrating an example of a pattern image for color registration. In FIG. 7, there is shown an ideal toner image formed on the transfer belt 152 and the ideal toner image moves in a vertical direction in FIG. 7 by a movement of the transfer belt 152. In FIG. 7, a horizontal direction is a main scanning direction (X axis) and a vertical direction is a sub-scanning direction (Y axis). Hereinafter, there will be mainly described black as a reference color, another color may be the reference color.

The pattern images in FIG. 7 includes first pattern images FK1, FC1, FM1, FY1, FK2, FC2, FM2, and FY2 that are images for obtaining offsets of other colors with respect to the reference color among a plurality of colors and second pattern images RK1, RC1, RM1, RY1, RK2, RC2, RM2, and RY2 that are images for obtaining the movement of the transfer belt 152 in the sub-scanning direction. Color registration errors are caused by an offset, and the offset includes X-offset, Y-offset, and W-offset that will be described later.

The first pattern image FK1 may include, as elements, a horizontal bar image BH in the shape of a bar elongated in the main scanning direction and a slant bar image BS in the shape of a bar elongated in a direction rotated by 45° with respect to the horizontal bar image BH. Other first pattern images FC1, FM1, FY1, FK2, FC2, FM2, and FY2 may also include the same. The second pattern image RK1 may include a plurality of horizontal bar images BH in the shape of bars elongated in the main scanning direction. Other second pattern images RC1, RM1, RY1, RK2, RC2, RM2, and RY2 may also include the same. The number of the horizontal bar images BH in each of the second pattern images RK1, RC1, RM1, RY1, RK2, RC2, RM2, and RY2 may be different from that of the example shown in FIG. 7.

Colors of the first pattern images FK1 and FK2 and the second pattern images RK1 and RK2 are black, colors of the first pattern images FC1 and FC2 and the second pattern images RC1 and RC2 are cyan, colors of the first pattern images FM1 and FM2 and the second pattern images RM1 and RM2 are magenta, and colors of the first pattern images FY1 and FY2 and the second pattern images RY1 and RY2 are yellow.

In the main scanning direction of the first pattern images FK1 and FK2, the second pattern images RK1 and RK2 that are black identical thereto are arranged, respectively. In the main scanning direction of the first pattern images FC1 and FC2, the second pattern images RC1 and RC2 that are cyan identical thereto are arranged, respectively. In the main scanning direction of the first pattern images FM1 and FM2, the second pattern images RM1 and RM2 that are magenta identical thereto are arranged, respectively. In the main scanning direction of the first pattern images FY1 and FY2, the second pattern images RY1 and RY2 that are yellow identical thereto are arranged, respectively. As described above, the image forming part 120 forms the first pattern images and the second pattern images having the same color side by side in the main scanning direction and transfers the same to the transfer belt 152.

The slant bar image BS of the first pattern image FK1 and the slant bar image BS of the first pattern image FK2 are arranged in the same straight line. There are present the same relations between the first pattern image FC1 and the first pattern image FC2, the first pattern image FM1 and the first pattern image FM2, and the first pattern image FY1 and the first pattern image FY2.

In FIG. 7, there are shown the spot SPL to which the sensing unit 170L scans and a spot SPR to which the sensing unit 170R scans. The first pattern images and the second pattern images of FIG. 7 are transferred to the transfer belt 152, and the transfer belt 152 moves the transferred first pattern images and second pattern images in the sub-scanning direction. Since the pattern images moves upwardly in FIG. 7, the sensing unit 170L senses an element of a pattern image on a straight line SL and the sensing unit 170R senses an element of a pattern image on a straight line SR. A distance between the straight line SL and the straight line SR may be, for example, 176 mm.

In S18, the location calculation unit 182 calculates locations in the sub-scanning direction for the elements included in the pattern images of FIG. 7 on the transfer belt 152, based on sensing results of the sensing units 170L and 170R. In detail, according to a command of the control unit 184, the sensing units 170L and 170R sense the respective elements of the pattern images of FIG. 7 and the location calculation unit 182 stores count values of synchronization signals HSY as measured values of the locations in the sub-scanning direction. The count values are the numbers of synchronization signals HSY (number of pulses of the synchronization signals HSY) at respective sensed points. The location calculation unit 182 stores measured values for the whole pattern images of FIG. 7.

Figure 8:
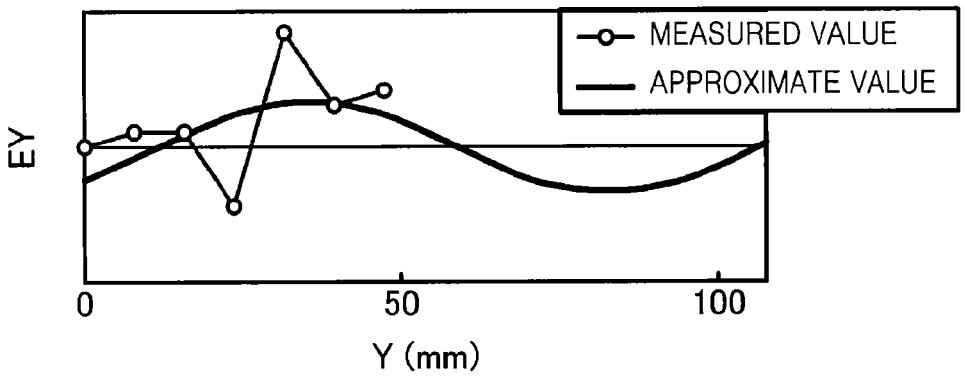
FIG. 8 is a graph illustrating an example of measured values of a rotational variance factor of the transfer belt of FIG. 1.

In S20, with respect to the second pattern image, the control unit 182 obtains a rotational variance factor, that is, an error from an ideal movement in the sub-scanning direction of the transfer belt 152 for each of the four colors of yellow, magenta, cyan, and black based on the location calculated by the location calculation unit 182. FIG. 8 is a graph illustrating an example of measured values of the rotational variance factor of the transfer belt 152. In FIG. 8, there are shown errors EY between locations of the elements included in, for example, the pattern image RK1 being actually obtained by the sensing units 170L and 170R and ideal locations.

The measured value in FIG. 8 may include noise and a variance factor of higher order. To remove an effect thereof and to obtain a primary factor of a vibration of the transfer belt 152, the control unit 184 approximates the measured value in FIG. 8 to, for example, a sine function. The control unit 184 calculates respective coefficients according to, for example, $$f(t)=A*\sin(2*\pi*f*t+B) \quad \text{Equation (1)}$$

where A indicates an amplitude, f indicates a frequency, t indicates time calculated using a distance and a moving speed of the transfer belt 152, and B indicates a phase. The control unit 184 calculates respective coefficients of Equation 1 using a least square method.

FIG. 9 is a table showing an example of the rotational variance factor. The table shows relations between a count value of synchronization signals HSY corresponding to a location in a sub-scanning direction and a rotational variance factor EY. In this case, a dot is a unit indicating the rotational variance factor EY in the sub-scanning direction. A length of one dot is determined based on the resolution of the image forming apparatus 100, for example, 600 dpi. One dot corresponds to, for example, 1024 pulses. The control unit 184 obtains the table in FIG. 9 using Equation 1 and stores the table in the location calculation unit 182.

S20, the control unit 184 processes the respective pattern images RC1, RM1, RY1, RK2, RC2, RM2, and RY2 as the same manner as the pattern image RK1 and the location calculation unit 182 stores the table as shown in FIG. 9 with respect to each of the pattern images RC1, RM1, RY1, RK2, RC2, RM2, and RY2.

Figure 10:
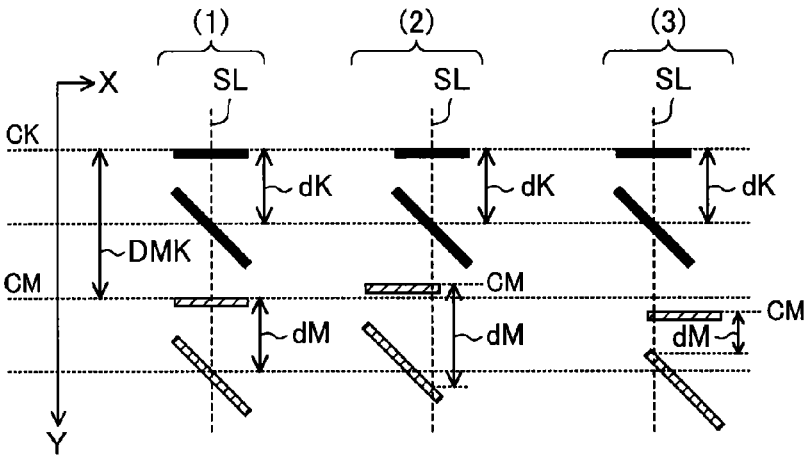
FIG. 10 is a diagram illustrating calculation of X-offset and Y-offset.

FIG. 10 is a diagram illustrating calculation of X-offset and Y-offset. The X-offset indicates a misalignment of a pattern image of any one color with respect to a pattern image of a reference color in a main scanning direction on the transfer belt 152. The Y-offset indicates a misalignment of a pattern image of any one color with respect to a pattern image of a reference color in a sub-scanning direction on the transfer belt 152. Here, as an example, there will be described an offset of magenta with respect to black. In FIG. 10, (1) corresponds to an ideal state where neither the X-offset nor the Y-offset exists, (2) corresponds to a case where a pattern image of magenta is misaligned in a direction of left top, and (3) corresponds to a case where the pattern image of magenta is misaligned in a direction of right bottom.

In S22, the control unit 184 corrects the measure value of the location of each of the first pattern images in the sub-scanning direction obtained in S18 by reducing the value in the table of FIG. 9. With respect to a count value (location) not shown in the table of FIG. 9, for example, a rotational variance factor EY is obtained using interpolation. In this case, the control unit 184 corrects the location of the first pattern image FK1 by using a corresponding table of FIG. 9 obtained from the second pattern image RK1. As well, the control unit 184 corrects the location of the first pattern image FC1 by using the table obtained from the second pattern image RC1, corrects the location of the first pattern image FM1 by using the table obtained from the second pattern image RM1, corrects the location of the first pattern image FY1 by using the table obtained from the second pattern image RY1, corrects the location of the first pattern image FK2 by using the table obtained from the second pattern image RK2, corrects the location of the first pattern image FC2 by using the table obtained from the second pattern image RC2, corrects the location of the first pattern image FM2 by using the table obtained from the second pattern image RM2, and corrects the location of the first pattern image FY2 by using the table obtained from the second pattern image RY2.

In S22, also the control unit 184 obtains an X-offset ΔX using a measured value after correction according to $$\Delta X=dK-dM \quad \text{Equation (2)}$$

where dK indicates an absolute value of a difference between a horizontal bar image BH and a slant bar image BS of black and dM indicates an absolute value of a difference between a horizontal bar image BH and a slant bar image BS of magenta. The control unit 184 sets an obtained value of ΔX as a correction value of X direction.

In S24, the control unit 184 obtains a Y-offset ΔY using a measured value after correction according to $$\Delta Y=(CM-CK)-DMK \quad \text{Equation (3)}$$

wherein CK and CM indicate measured values of the horizontal bar images BH of black and magenta, respectively. DMK indicates a difference between the locations (a difference between count values of synchronization signals HSY of the pattern image of magenta and the pattern image of black) in an ideal case. The control unit 184 sets obtained ΔY as a correction value of Y direction.

Figure 11:
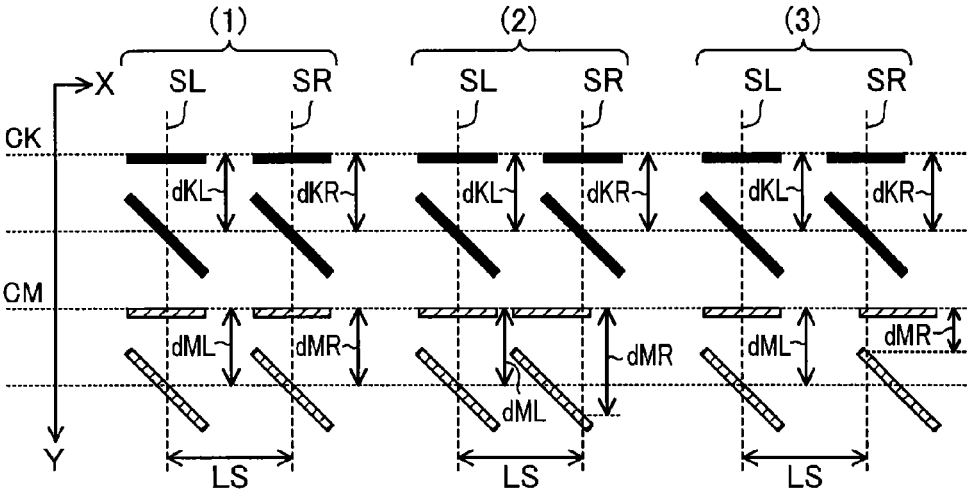
FIG. 11 is a diagram illustrating calculation of W-offset.

FIG. 11 is a diagram illustrating calculation of W-offset. The W-offset is a magnification error of a pattern image of any one color with respect to a pattern image of a reference color in a main scanning direction. In this case, for example, there will be described an offset of magenta with respect to black. The same description may be applied to offsets of yellow and cyan with respect to black. In FIG. 11, (1) corresponds to an ideal state where no W-offset exists, (2) corresponds to a case where the magnification of the pattern image of magenta is smaller, and (3) corresponds to a case where the magnification of the pattern image of magenta is greater.

In S26, the control unit 184 obtains the W-offset ΔW by using a measured value after correction according to $$\Delta W=1+\{(dMR-dKR)-(dML-dKL)\}/LS \quad \text{Equation (4)}$$

wherein, with respect to a pattern image on a straight line SR, dKR indicates an absolute value of a difference between measured values of a horizontal bar image BH and a slant bar image BS of black and dMR indicates an absolute value of a difference between measured values of a horizontal bar image BH and a slant bar image BS of magenta. With respect to a pattern image on a straight line SL, dKL indicates an absolute value of a difference between measured values of a horizontal bar image BH and a slant bar image BS of black and dML indicates an absolute value of a difference between measured values of a horizontal bar image BH and a slant bar image BS of magenta. LS indicates a distance between the straight line SL and the straight line SR. The control unit 184 sets obtained ΔW as a correction value of a magnification in X direction.

Processes of S22, S24, and S26 are performed with respect to yellow and cyan like the preceding. Also, when an angle between a slant bar image BS and a horizontal bar image BH is not 45°, ΔX or ΔY may be obtained considering the angle formed by both the slant bar image BS and the horizontal bar image BH.

Figure 12:
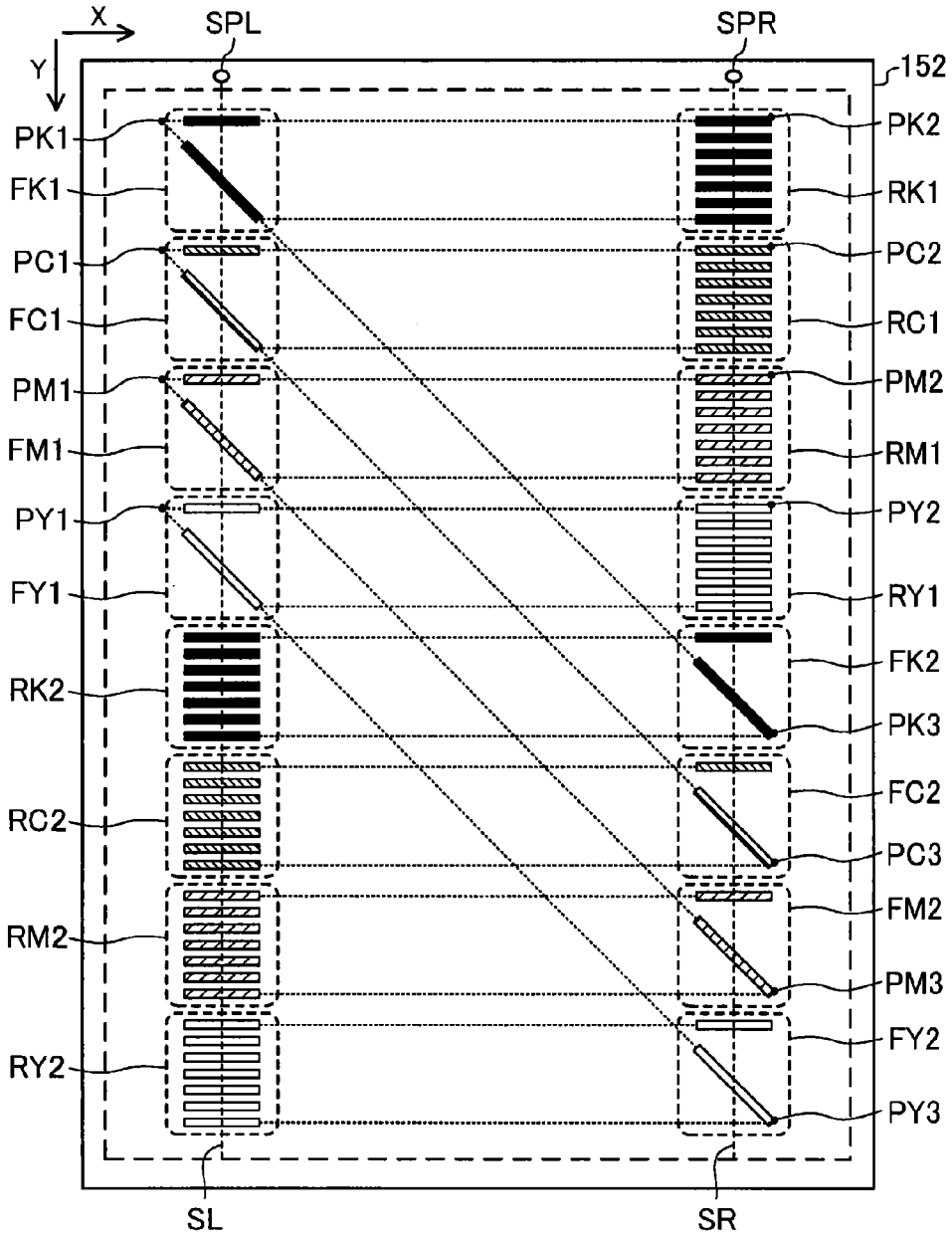
FIG. 12 is a diagram illustrating a distortion calculation process.

In S28, the control unit 184 performs a distortion calculation process. FIG. 12 is a diagram illustrating the distortion calculation process. In FIG. 12, a point PK1 is an intersection point of extension lines of two elements of the pattern image FK1, a point PK2 is an end point on right top of the pattern image RK1, and a point PK3 is an end point on right bottom of the pattern image FK2. A point PC1 is an intersection point of extension lines of two elements of the pattern image FC1, a point PC2 is an end point on right top of the pattern image RC1, and a point PC3 is an end point on right bottom of the pattern image FC2. A point PM1 is an intersection point of extension lines of two elements of the pattern image FM1, a point PM2 is an end point on right top of the pattern image RM1, and a point PM3 is an end point on right bottom of the pattern image FM2. A point PY1 is an intersection point of extension lines of two elements of the pattern image FY1, a point PY2 is an end point on right top of the pattern image RY1, and a point PY3 is an end point on right bottom of the pattern image FY2.

There are considered a triangle TRK formed by connecting the three points PK1, PK2, and PK3, a triangle TRC formed by connecting the three points PC1, PC2, and PC3, a triangle TRM formed by connecting the three points PM1, PM2, and PM3, and a triangle TRY formed by connecting the three points PY1, PY2, and PY3. In an ideal state, areas of these triangles are the same, and the control unit 184 may store the area in an ideal state, in advance.

The control unit 184 obtains the areas of the triangles TRK, TRC, TRM, and TRY by using corrected measured values of locations of respective toner images on the transfer belt 152 obtained via S22. The control unit 184 obtains ratios of the obtained areas of the respective triangles TRK, TRC, TRM, and TRY with respect to the areas in an ideal state.

In S30, the control unit 184 determines whether the ratios obtained via S28 are within a predetermined range, for example, 0.8 to 1.2. When the ratios are within the range, the control unit 184 finishes the process in FIG. 6. When the ratios are out of the range, it is considered that there is the problem in an image quality and S34 is performed.

In S34, the control unit 184 processes an error. In detail, the control unit 184 notifies the user of error information notifying a disorder of the apparatus and finishes the processing. In this case, the control unit 184 may display the error information on a display (not shown) and may notify the error information to an administration center via a communication line.

The control unit 184 stores the areas of the triangles TRK, TRC, TRM, and TRY in each of ideal states, for example, 0° C. (degree of centigrade), 20° C., and 40° C., respectively, and may use proper ones of the stored values depending on a temperature of the transfer belt 152 and a peripheral temperature thereof when measuring locations of toner images.

In S28 and S30, there is used the triangle formed by connecting the PK1, PK2, and PK3. However, there may be used a triangle formed by connecting other three points on the toner image of the same color. Also, a distance between two points on the toner image of the same color may be used.

According to the processing result as described above, the control unit 184 performs color registration by controlling the signal generation unit 186. In detail, the control unit 184 may change timings of a line synchronization signal and a page synchronization signal with respect to respective colors. When generating an image signal VD according to image data PD, the signal generation unit 186 may change a location of an image in such a way that the offsets ΔX and ΔY become smaller with respect to respective colors. Also, in order to reduce the offset ΔW, the control unit 184 may magnify a frequency of a video clock signal with respect to respective colors by ΔW and supplies the same to the signal generation unit 186.

Figure 13:
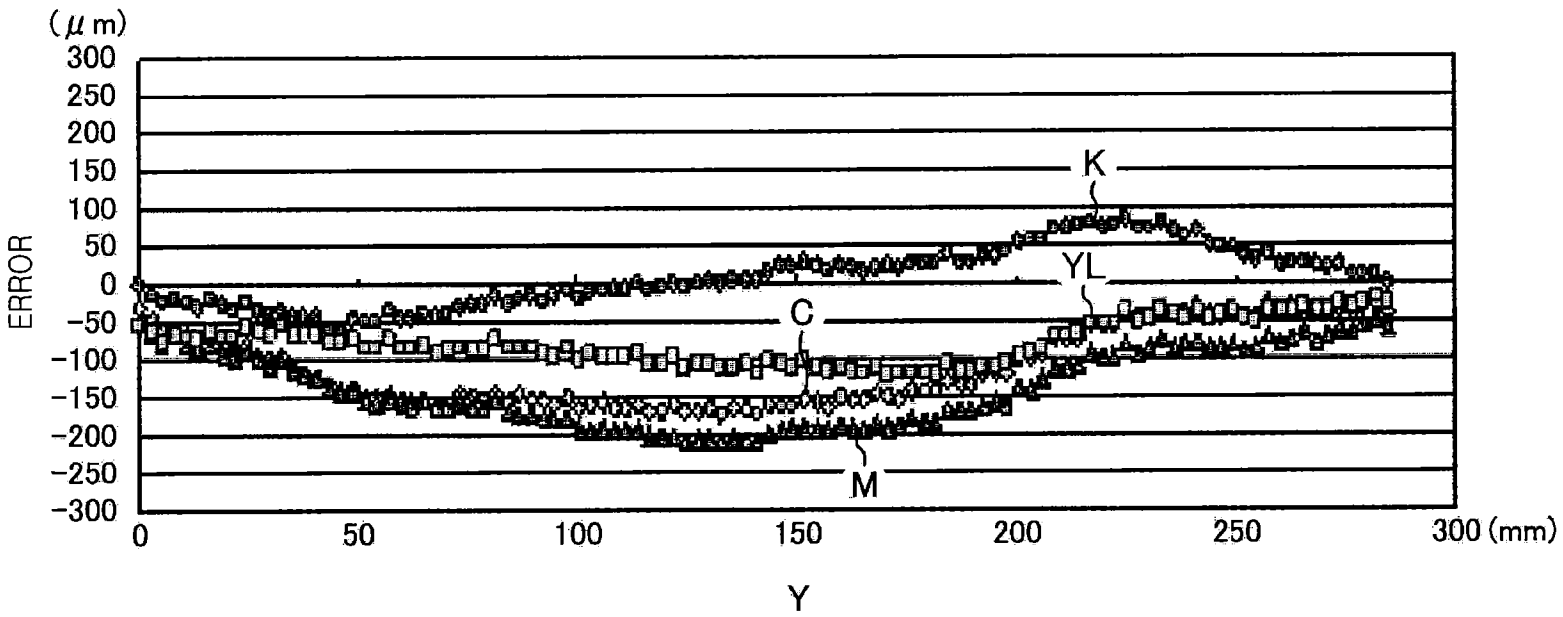
FIG. 13 is a graph illustrating an example of an error in a location of the toner image after color registration when not considering the rotational variance factor.
Figure 14:
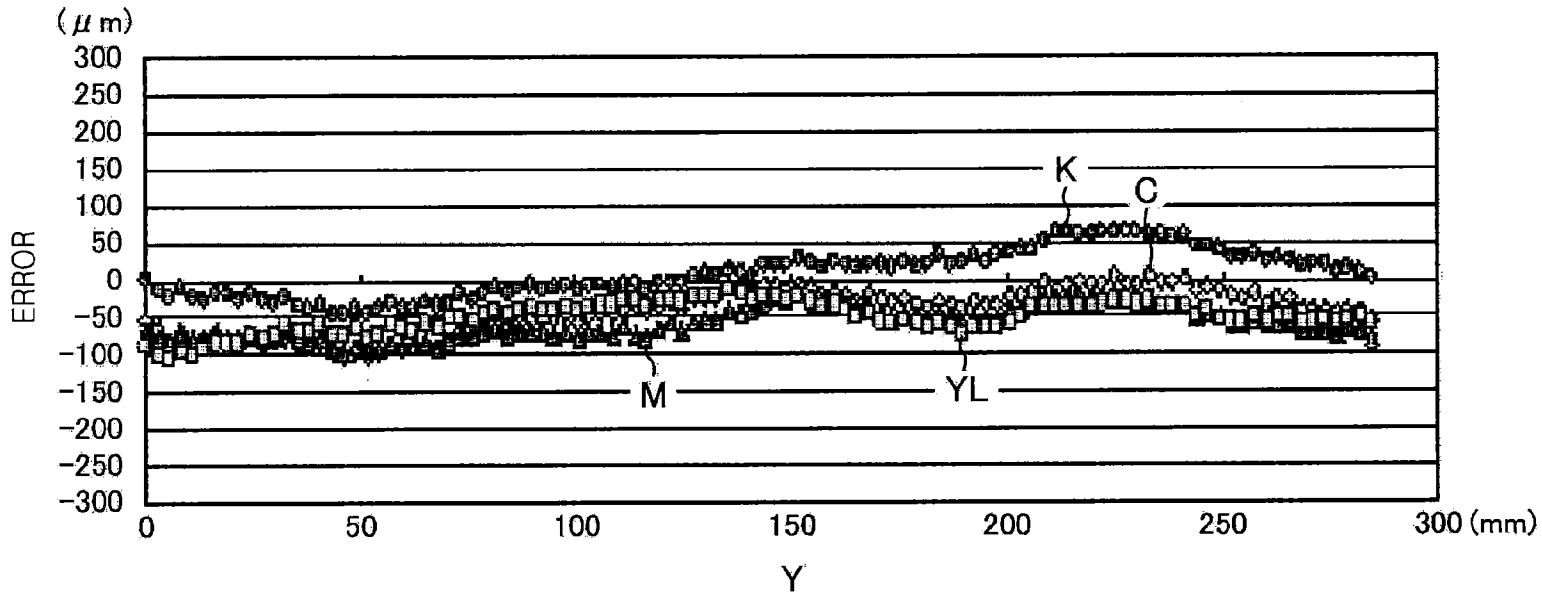
FIG. 14 is a graph illustrating an example of an error in a location of the toner image after color registration performed by the image forming apparatus of FIG. 1.

FIG. 13 is a graph illustrating an example of an error in a location of a toner image after color registration when not considering a rotational variance factor. In this case, the error is about 220 micro-meter (μm). FIG. 14 is a graph illustrating an example of an error in a location of a toner image after color registration performed by the image forming apparatus 100. In this case, the error is about 90 μm. As described above, the error of the location of the toner image is greatly improved.

As described above, the image forming apparatus 100 measures an offset based on a toner image of a pattern image being actually formed on the transfer belt 152. Since the offset is measured by considering a rotational variance factor by using pattern images of the same color arranged side by side in a main scanning direction, it is possible to perform color registration with a higher degree of precision. Since sensing a pattern image for sensing an offset while sensing a pattern image for obtaining the rotational variance factor, it is possible to reduce a processing time compared with a case of sequentially processing respectively.

As an example, the control unit 184 may perform the process of FIG. 6 when the transfer belt 152 is exchanged, when there is present an environmental change while turning the power on (that is, when a peripheral temperature or a power voltage becomes a predetermined value), or when the number of copies reaches a predetermined number. When the environmental change occurs or when the number of copies reaches a predetermined number, the process of S20 may be omitted. In that case, it is possible to use a table of rotational variance factors obtained hitherto.

When an error is sensed, the control unit 184 may perform color registration based on offsets obtained prior thereto.

It is possible to use other pattern images instead of the pattern images in FIG. 7. For example, though it has been described that each of the pattern images FK1, etc. has the horizontal bar image BH and the elongated slant bar BS rotated at 45° with respect to the horizontal bar image BH, the angle between the slant bar image BS and the horizontal bar image BH may be another angle excluding 0° and 90°.

In FIG. 7, it is possible to exchange the pattern image FK1 for the pattern image RK1. It is possible to exchange the pattern image FC1 for the pattern image RC1. It is possible to exchange the pattern image FM1 for the pattern image RM1. It is possible to exchange the pattern image FY1 for the pattern image RY1. It is possible to exchange the pattern image FK2 for the pattern image RK2. It is possible to exchange the pattern image FC2 for the pattern image RC2. It is possible to exchange the pattern image FM2 for the pattern image RM2. It is possible to exchange the pattern image FY2 for the pattern image RY2. These exchanges may be separately performed.

In the present specification, respective functional blocks may, typically, be embodied as hardware configurations. For example, the respective functional blocks may be formed on a semiconductor substrate as a part of an integrated circuit (IC). In this case, IC includes a large-scale integrated circuit (LSI), an application-specific integrated circuit (ASIC), a gate array, and a field programmable gate array (FPGA). Instead, some or the whole respective functional blocks may be embodied as software configurations. For example, such functional blocks may be embodied by a processor and a program executed in the processor. In other words, the respective functional blocks described in the present specification may be embodied as hardware configurations, software configurations, and a combination thereof.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus forming an image in a plurality of colors comprising a reference color, the apparatus comprising:

an image forming part forming a first pattern image and a second pattern image in the same color side by side in a main scanning direction, with respect to each of the plurality of colors;

an intermediate transfer belt to which the first pattern image and the second pattern image formed by the image forming part are transferred, the intermediate transfer belt conveying the transferred first pattern image and second pattern image in a sub-scanning direction, which is perpendicular to the main scanning direction;

a first sensing unit to sense an element of the first pattern image on the intermediate transfer belt;

a second sensing unit to sense an element of the second pattern image on the intermediate transfer belt;

a location calculation unit to obtain locations in the sub-scanning direction for the elements of the first pattern image and the second pattern image of the plurality of colors on the intermediate transfer belt based on results of sensing performed by the first and second sensing units; and a control unit to obtain rotational variance factors of the intermediate transfer belt for each of the plurality of colors based on the obtained locations with respect to the second pattern image obtained by the location calculation unit, to correct the location obtained with respect to the first pattern image based on the rotational variance factor obtained with respect to the color of the first pattern image, to obtain an offset of another color with respect to the reference color based on the location after correction, and to perform color registration based on the obtained offset to reduce the offset, wherein the first pattern image is an image for obtaining an offset of another color with respect to the reference color among the plurality of colors, and wherein the second pattern image is an image for obtaining a movement of the intermediate transfer belt in the sub-scanning direction.

2. The apparatus of claim 1, wherein the first pattern image comprises a first bar image elongated in the main scanning direction, and a second bar image in the direction of the angle, which is between the main scanning direction and the sub-scanning direction, and the second bar image is elongated in directions excluding the sub-scanning direction, with respect to each of the plurality of colors.

3. The apparatus of claim 2, wherein the second pattern image comprises a bar image elongated in the main scanning direction, with respect to each of the plurality of colors.

4. The apparatus of claim 1, wherein the control unit obtains an offset of the another color with respect to the reference color when turning the power on.

5. The apparatus of claim 1, further comprising a signal generation unit to generate an image signal from image data based on a synchronization signal, wherein the image forming part forms an image based on the image signal, and wherein the control unit changes the synchronization signal based on the location after the correction, thereby performing the color registration.

6. The apparatus of claim 1, wherein the control unit performs the color registration based on an offset obtained prior thereto when an error is sensed.

7. The apparatus of claim 1, wherein the image forming part forms an image in such a way that the second pattern images of the plurality of colors is transferred to locations in a sub-scanning direction with respect to the first pattern images of the plurality of colors and the first pattern images of the plurality of colors is transferred to locations in a sub-scanning direction with respect to the second pattern images of the plurality of colors on the intermediate transfer belt.

8. The apparatus of claim 1, wherein the control unit obtains a ratio of an area of a triangle formed by connecting three points in the first pattern image and the second pattern image of the same color to an area thereof in an ideal state and processes an error when the obtained ratio is out of a predetermined range.

9. A color registration method performed by an image forming apparatus forming an image in a plurality of colors comprising a reference color, the method comprising:

forming a first pattern image and a second pattern image in the same color being arranged side by side in a main scanning direction, with respect to each of the plurality of colors;

transferring the first pattern image and the second pattern image formed by the image forming part to an intermediate transfer belt and conveying the transferred first pattern image and second pattern image in a sub-scanning direction, which is perpendicular to the main scanning direction;

sensing an element of the first pattern image on the intermediate transfer belt;

sensing an element of the second pattern image on the intermediate transfer belt;

obtaining locations in the sub-scanning direction for the elements of the first pattern image and second pattern image of the plurality of colors on the intermediate transfer belt based on results of sensing performed by the first and second sensing units;

obtaining rotational variance factors of the intermediate transfer belt for each of the plurality of colors based on the obtained locations with respect to the second pattern image obtained by the location calculation unit;

correcting the location obtained with respect to the first pattern image based on the rotational variance factor obtained with respect to the color of the first pattern image;

obtaining an offset of another color with respect to the reference color based on the location after correction; and performing color registration based on the obtained offset to reduce the offset, wherein the first pattern image is an image for obtaining an offset of another color with respect to the reference color among the plurality of colors, and wherein the second pattern image is an image for obtaining a movement of the intermediate transfer belt in the sub-scanning direction.

10. A color registration method performed by an image forming apparatus forming an image in a plurality of colors including a reference color, the method comprising:

forming a first pattern image and a second pattern image in the same color arranged side by side in a main scanning direction for each of the plurality of colors;

obtaining rotational variance factors of a transfer belt for each of the plurality of colors based on locations with respect to the second pattern image;

correcting the location obtained with respect to the first pattern image based on the rotational variance factor obtained with respect to the color of the first pattern image;

obtaining an offset of another color with respect to the reference color based on the location after correction; and performing color registration based on the obtained offset to reduce the offset.

* * * * *